US006253479B1

(12) United States Patent
Fuchs et al.

(10) Patent No.: US 6,253,479 B1
(45) Date of Patent: Jul. 3, 2001

(54) PISTOL HAVING A SAFETY FOR PREVENTING ACCIDENTAL FIRING

(75) Inventors: Rudolf Fuchs, Thayngen (CH); Michael Osterrath, Jestetten (DE)

(73) Assignee: SIG Arms International AG, Neuhausen am Rheinfall (CH)

( * ) Notice: Subject to any disclaimer, the term of this patent is extended or adjusted under 35 U.S.C. 154(b) by 0 days.

(21) Appl. No.: 09/325,736

(22) Filed: Jun. 4, 1999

(51) Int. Cl.[7] ..... F41A 17/36

(52) U.S. Cl. ..... 42/70.02; 42/71.01; 42/75.01; 42/71.02

(58) Field of Search ..... 42/75.01, 71.02, 42/71.03, 71.01, 49.01, 100, 103, 72, 70.02; 89/37.04; 124/31, 45, 83

(56) References Cited

U.S. PATENT DOCUMENTS 3,857,325 * 12/1974 Thomas ..... 89/138
4,107,863 * 8/1978 Musgrave ..... 42/50
4,420,899 * 12/1983 Bourlet et al. ..... 42/70
4,428,138 * 1/1984 Seecamp ..... 42/70 A
4,528,765 * 7/1985 Johnson ..... 42/1 LP
4,628,627 * 12/1986 Johnson ..... 42/90
5,225,612 * 7/1993 Bernkrant ..... 42/70.02
5,388,362 * 2/1995 Melcher ..... 42/70.02
5,815,973 * 10/1998 Hochstrate ..... 42/69.03
6,000,162 * 12/1999 Hochstrate ..... 42/69.03

* cited by examiner

*Primary Examiner*—Michael J. Carone
*Assistant Examiner*—John Richardson
(74) *Attorney, Agent, or Firm*—Venable; Gabor J. Kelemen

(57) ABSTRACT

The pistol comprises a frame. A trigger is mounted in the frame and is pivotable between a release position and a firing position and spring urged into the release position. The frame comprises a grip portion with a magazine well in which a magazine is removably inserted. A trigger bar is pivotally attached to the trigger and spring urged upwardly. The trigger bar has an abutment member at its rear end which coacts with a sear member that is movably mounted in the frame. A safety member is mounted on the grip portion and is movable between two positions. At its upper end the safety member has a catch for engaging the trigger bar. A second spring urges the safety member into its first position in which the catch pulls the trigger bar down out of engagement with the sear member. The safety member has an abutment face which is engaged by a part of the magazine when the latter is inserted. The part pushes the safety member into its second position in which the catch is out of engagement with the trigger bar.

4 Claims, 2 Drawing Sheets

PISTOL HAVING A SAFETY FOR PREVENTING ACCIDENTAL FIRING

FIELD AND BACKGROUND OF THE INVENTION

A pistol comprising a frame, a pivotable trigger and a trigger guard for protecting the trigger is described in U.S. patent application Ser. No. 09/234,420 filed Jan. 20, 1999 and Ser. No. 09/255,725 filed Feb. 23, 1999 which are declared an integral part of the present patent application.

A further pistol with the above elements is described in European patent No. 77 790 and in U.S. Pat. No. 5,669,169.

SUMMARY OF THE INVENTION

It is an object of the present invention to increase the safety of such a pistol against accidental firing.

This object and others to become apparent as the specification progresses are accomplished by the invention according to which, briefly stated, the pistol comprises a frame. A trigger is mounted in the frame and is pivotable between a release position and a firing position and spring urged into the release position. The frame comprises a grip portion with a magazine well in which a magazine is removably inserted. A trigger bar is pivotally attached to the trigger and spring urged upwardly. The trigger bar has an abutment member at its rear end which coacts with a sear member that is movably mounted in the frame. A safety member is mounted on the grip portion and is movable between two positions. At its upper end the safety member has a catch for engaging the trigger rail. A spring urges the safety member into its first position in which the catch pulls the trigger bar down out of engagement with the sear member. The safety member has an abutment face which is engaged by a part of the magazine when the latter is inserted. The part pushes the safety member into its second position in which the catch is out of engagement with the trigger bar.

DETAILED DESCRIPTION OF A PREFERRED EMBODIMENT

Figure 1:
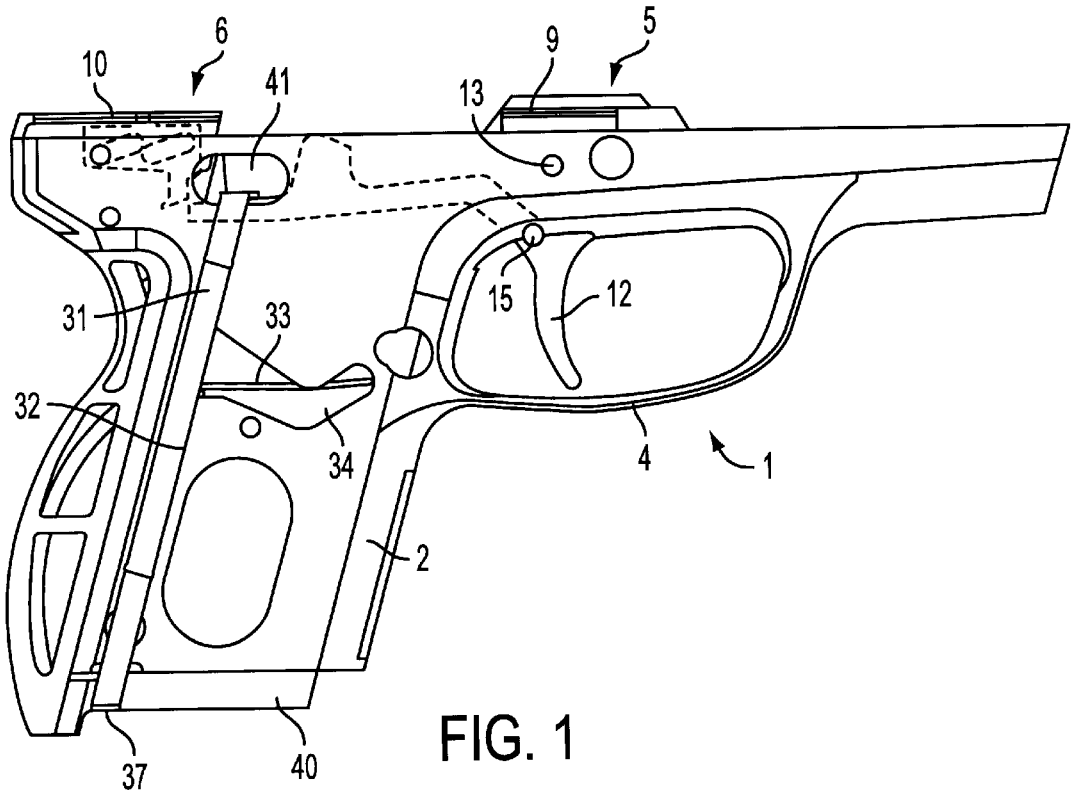
FIGS. 1 and 2 show a side view of a frame of a pistol without and with inserted magazine.
Figure 2:
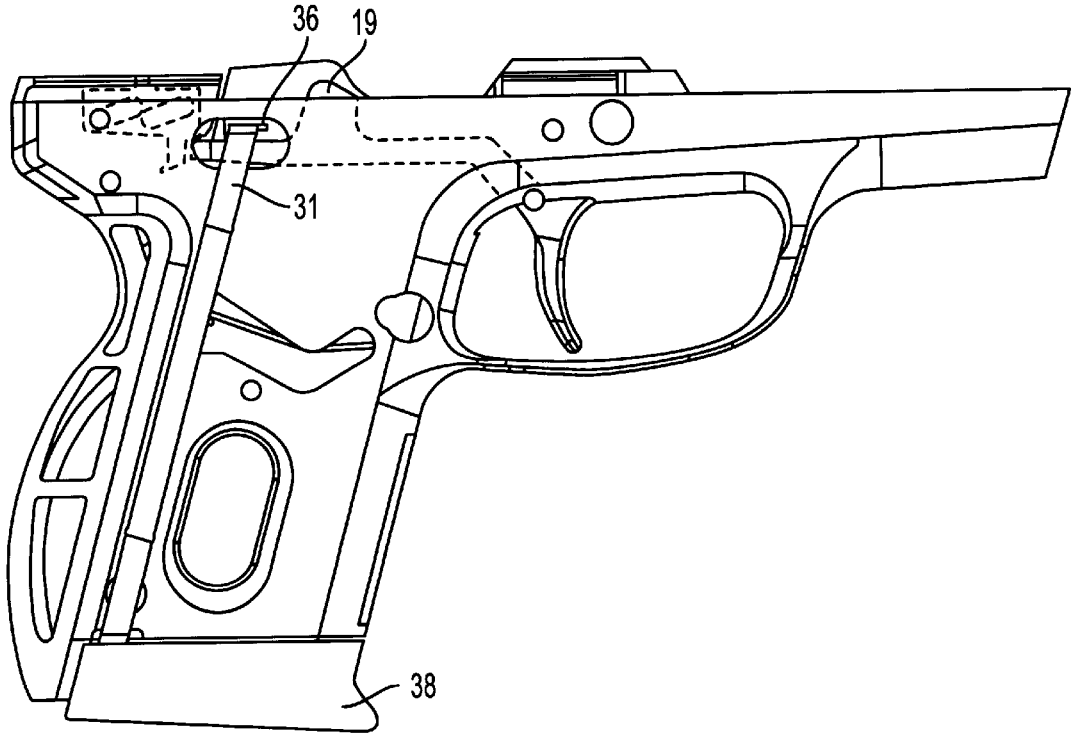

The frame 1 of a pistol consists of a thermoplast or of an aluminum alloy. It comprises a grip portion 2 with a magazine well 3 for receiving a magazine 8. A trigger guard 4 is integrally formed with the frame 1. A forward insert 5 of steel is inserted into the frame 1 above the trigger guard 4. This forward insert 5 is described in more detail in U.S. patent application Ser. No. 09/255,725 incorporated herein by reference. A rear insert 6 also mounted to the frame 1 comprises part of a trigger mechanism 7 described in detail in U.S. patent application Ser. No. 09/234,420 incorporated by reference. A slide (not shown) is slidably guided on rails 9, 10 of the inserts 5, 6 and contains the barrel, a return spring, a firing pin and a firing spring.

A trigger 12 is pivotally mounted in the insert 5 by a pin 13. A trigger bar 14 is pivotally attached to the trigger 12 by a pin 15. A spiral spring 16 urges the trigger 12 forwardly and the trigger bar 14 upwardly. The trigger bar 14 has two legs 17 straddling an inserted magazine 8. At their rearward end the legs 17 are interconnected by a web (abutment member) 18. Each leg 17 carries a respective lug 19 extending into longitudinal grooves of the slide when the latter is in its basic position.

The rear insert 6 is secured to the frame 1 by several transverse pins 20. A sear member 21 has rearwardly downward inclined slots 22 through which respective pins 20 pass for holding and guiding the sear member 21 for displacement parallel to itself. The sear member 21 has an upwardly projecting, formed-on catch lug 23 provided with a rearward face which extends parallel to a frontal end face of a firing pin catch.

The sear member 21 is urged by a sear spring 24 into the basic position in which the pins 20 abut the rearward terminal edge of the slots 22. The catch lug 23 of the sear member 21 is, in such a position, in the travelling path of the firing pin catch.

Upon executing a charging motion, that is, upon manually pulling the slide rearwardly while the firing pin is in a released state, the firing pin catch pushes the sear member 21 rearwardly against the force of the spring 24 until the firing pin catch glides past above the catch lug 23 of the sear member 21. During the successive forward motion of the slide urged by a slideclosing spring, the firing pin catch is caught by the catch lug 23 of the sear member 21, whereby the firing pin spring is armed.

When the trigger 12 is pulled against the force of the trigger spring 16, after a certain trigger path the web 18 abuts a lug 25 of the sear member 21 and pushes the sear member 21 against the force of the spring 24 rearwardly until the catch lug 23 disengages from the firing pin catch. As a result of such an occurrence, the firing pin is released and accelerated forwardly by the firing pin spring, whereupon a shot is fired. During the successive recoil of the slide the cams 19 of the trigger bar 14 run at the frontal end of grooves onto the slide so that the trigger bar 14 is pivoted downwardly and the sear member 21 snaps back into its basic position in which, during the forward motion (recuperating motion) of the slide which follows its recoil, the catch lug 23 of the sear member 21 again arrests and holds the firing pin catch, thus arming the firing pin.

On one side of the grip portion 2 a safety bar 31 of sheet metal is slidably guided in a groove 32 and urged downwardly by a bending spring 33 which is inserted in a recess 34 of the grip portion. The spring 33 is engaged in a recess 35 of the bar 31. At its upper end the bar 31 is bent to form a catch 36 which extends through an opening 41 in a side wall of the magazine well 3. The catch 36 overlaps one of the legs 17 of the trigger bar 14. The lower end of the bar 31 is also bent inwards to form an abutment face 37. When the magazine 8 is inserted into the magazine well 3 a bottom closure 38 of the magazine 8, which surrounds the side walls 39 of the magazine, pushes the abutment face 37 and therefore the bar 31 upwards so that the catch 36 is out of engagement with the trigger bar 14. In FIG. 1 the frame 1 is shown with a grip plate 40 mounted to the rear side. In the mounted stage a symmetrical grip plate 40 is also mounted to the visible front side of the grip portion 2. This grip plate covers the bar 31 and spring 33. When the magazine 8 is removed, the abutment face 37 does not extend below the lower edge of the grip plates 40.

Figure 3:
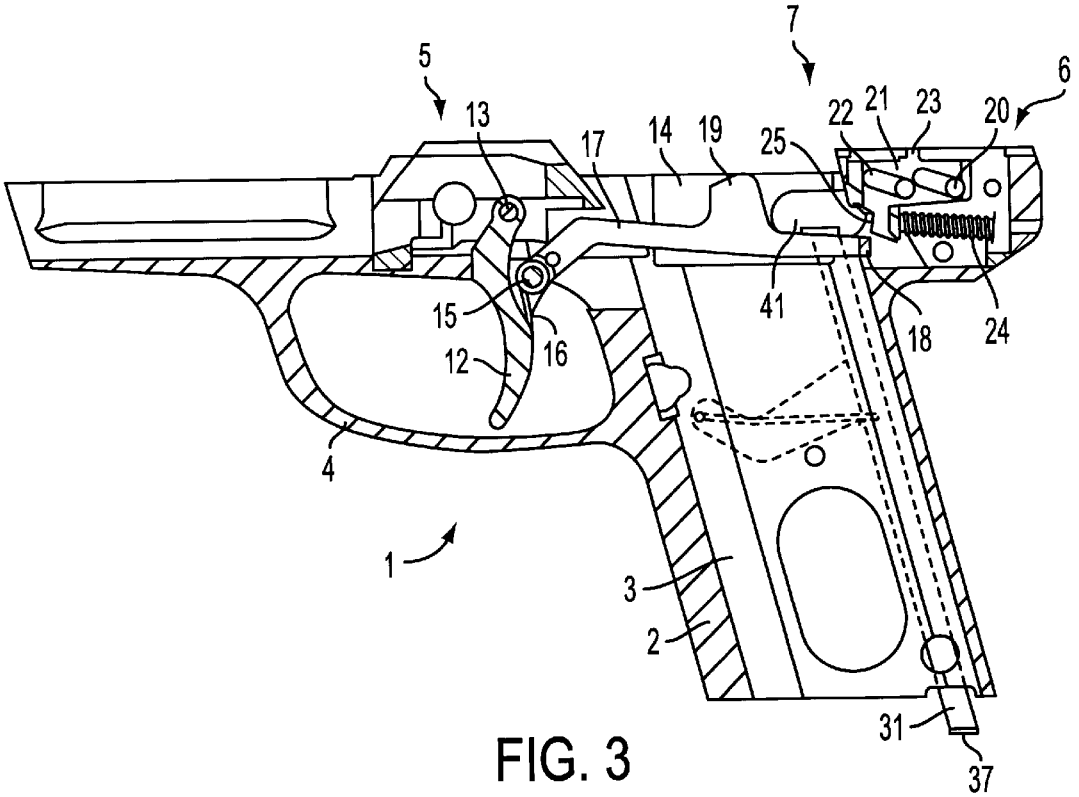
FIGS. 3 and 4 show analogous longitudinal sections.
Figure 4:
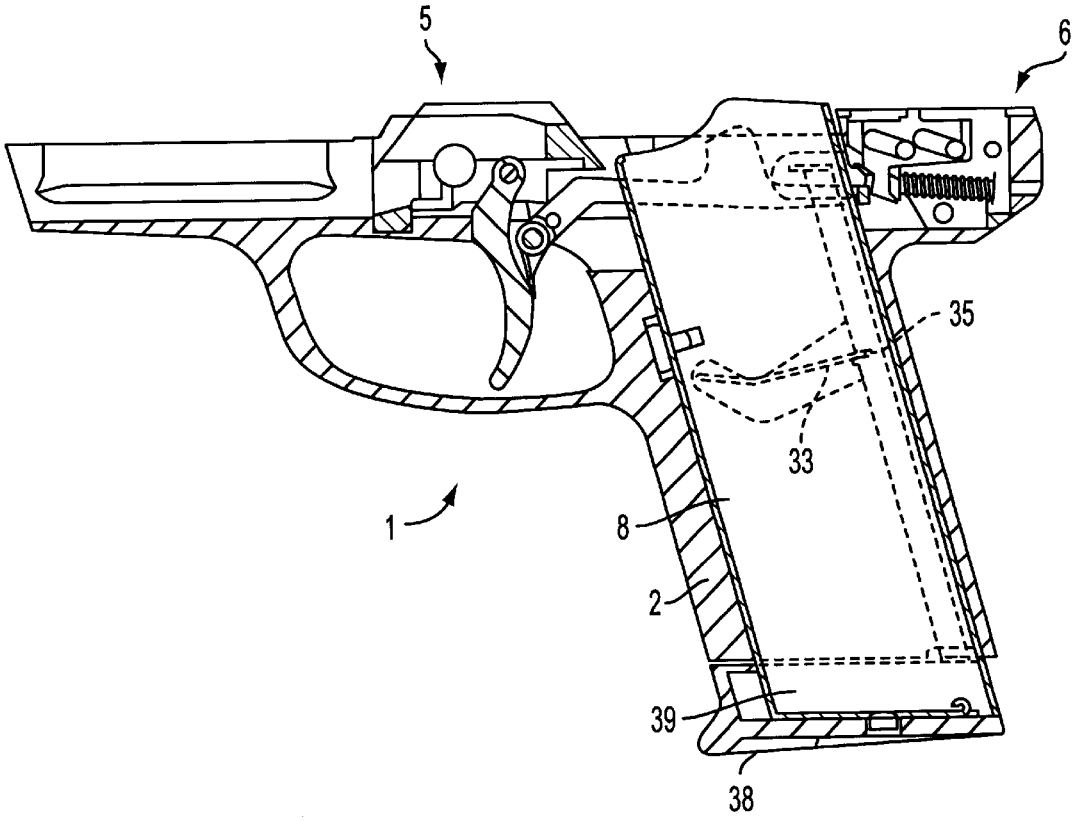

When the magazine 8 is removed, the spring 33 pulls the bar 31 downwards. The force of the spring 33 is larger than the torque exerted by the spring 16 on the trigger bar 14 divided by the distance between the pin 15 and the catch 36 so that the trigger bar 14 is pivoted down as shown in FIGS. 1 and 3. In this position the web 18 is out of engagement with the lug 25 of the sear member 21. Therefore, firing of the pistol is not possible with the magazine 8 removed even if a cartridge is still in the barrel of the pistol.

For securing the pistol it is therefore only necessary to remove the magazine 8. The described safety mechanism also increases the security against shocks when the pistol hits a hard surface. The inertia of the masses of the trigger 12 and of the trigger bar 14 cannot act on the sear member 21 as long as the magazine 8 is removed.

What is claimed is:

1. A pistol comprising (a) a frame including a grip portion containing a magazine well;

(b) a magazine insertable into and removable from said magazine well to assume a respective inserted and removed state;

(c) a sear member movably mounted in said frame;

(d) a trigger movably mounted in said frame;

(e) a trigger bar pivotally attached to said trigger; said trigger bar having an operative position in which said trigger bar assumes a coacting relationship with said sear member for allowing said sear member to be moved by said trigger; said trigger bar having an inoperative position in which said trigger bar assumes an inoperative relationship with said sear member for preventing said sear member from being moved by said trigger;

(f) a first spring urging said trigger bar into said operative position;

(g) a second spring; and (h) a safety member mounted to said grip portion; said safety member having a catch arranged for engaging said trigger bar and an abutment face arranged for engaging said magazine; said safety member having a first position which said safety member assumes when said magazine is in said removed state; in said first position of said safety member said catch thereof holding said trigger bar in said inoperative position; said second spring being coupled to said safety member and urging said safety member into said first position thereof; in said inserted state of said magazine said abutment face of said safety member being in engagement with said magazine and said safety member being placed into a second position thereof; in said second position of said safety member said catch thereof being clear of said trigger bar for allowing said trigger bar to be placed into said operative position by said first spring.

2. The pistol according to claim 1, wherein the safety member is a bar slidably guided on the grip portion.

3. The piston according to claim 1, wherein the magazine has a bottom closure cooperating with said abutment face of said safety member.

4. The pistol according to claim 1, wherein the safety member is mounted on an outer side of the grip portion and covered by a grip plate mounted to the grip portion.

* * * * *